US008011544B1

(12) United States Patent
Howell

(10) Patent No.: US 8,011,544 B1
(45) **Date of Patent: *Sep. 6, 2011**

(54) HINGED POCKET

(76) Inventor: Frank A. Howell, Oxford, ME (US)

( * ) Notice: Subject to any disclaimer, the term of this patent is extended or adjusted under 35 U.S.C. 154(b) by 348 days.

This patent is subject to a terminal disclaimer.

(21) Appl. No.: 12/347,016

(22) Filed: Dec. 31, 2008

(51) Int. Cl.
*A45F 5/00* (2006.01)

(52) U.S. Cl. ..... 224/668; 224/196; 224/242; 224/245; 224/247; 224/675; 224/931; 24/3.7

(58) Field of Classification Search ..... 224/193, 224/196, 241, 242, 245, 663, 665, 668, 671, 224/674, 675, 676, 678, 679, 680, 683; 24/3.7, 24/578.13, 578.17, 580.1, DIG. 37
See application file for complete search history.

(56) References Cited

U.S. PATENT DOCUMENTS

| | | | | | |
|---|---|---|---|---|---|
| 1,553,066 | A | * | 9/1925 | Burger | 224/242 |
| 2,778,080 | A | * | 1/1957 | Kernicki | 24/3.5 |
| 3,128,926 | A | | 4/1964 | Stella | |
| 4,546,898 | A | * | 10/1985 | Ekuan | 206/737 |
| 4,801,011 | A | * | 1/1989 | Desdoigts et al. | 206/389 |
| 4,923,105 | A | * | 5/1990 | Snyder | 224/255 |
| 5,505,356 | A | * | 4/1996 | Noriega et al. | 224/250 |
| 5,724,707 | A | | 3/1998 | Kirk et al. | |
| 5,833,095 | A | * | 11/1998 | Russell et al. | 224/576 |
| 6,154,997 | A | | 12/2000 | Aluotto et al. | |
| 6,202,908 | B1 | | 3/2001 | Groover | |
| 6,286,798 | B1 | | 9/2001 | Chun | |
| 6,327,805 | B1 | | 12/2001 | Clifton, Jr. | |
| 6,604,659 | B1 | | 8/2003 | Graves | |
| 6,708,838 | B2 | * | 3/2004 | Bergman et al. | 220/757 |
| 6,883,261 | B2 | | 4/2005 | Fitzpatrick | |
| 7,080,430 | B2 | * | 7/2006 | Wemmer | 24/578.13 |
| 7,222,762 | B2 | * | 5/2007 | Rees et al. | 224/148.4 |

* cited by examiner

*Primary Examiner* — Nathan J Newhouse
*Assistant Examiner* — Steven M Landolfi, Jr.
(74) *Attorney, Agent, or Firm* — Gesmer Updegrove LLP

(57) ABSTRACT

A pocket for an article having oppositely facing sides, comprising a front component cooperating in a nested relationship with a back component to define a chamber having an open upper end sized to receive the article. The front and back components, when in their nested relationship, having confronting front and back walls and overlapping bottom walls closing the lower end of the chamber. The bottom walls are interconnected in a manner accommodating movement of the front component relative to the back component between a closed position at which the sides of an article received in the chamber via the open upper end are tightly confined between the front and back walls, and a release position at which the front wall is deflected away from the back wall to accommodate removal of the article from the chamber via the open upper end. A back mounting bar extends across and cooperates in spaced relationship with the exterior of the back wall to define parallel back channels. A pair of flexible mounting straps have lower ends and upper ends joined by a transverse web. The mounting straps extend downwardly through the back channels along the exterior of the back wall. The lower ends of the mounting straps are detachably connected to one of the bottom walls. The mounting straps cooperate with the exterior of the back wall to define a belt receiving slot.

8 Claims, 10 Drawing Sheets

HINGED POCKET

BACKGROUND DISCUSSION

This invention relates to hinged pockets of the type disclosed in published patent application No. US2008/0105722A1, the description of which is herein incorporated by reference.

One objective of the present invention is to improve the manner in which such hinged pockets are detachably mounted on a wearer's belt of other like garment strap. A related objective of the present invention is to stabilize the thus mounted pocket against pivotal movement from an optimum vertical orientation.

Still another objective of the present invention is to enable the hinged pockets to be stacked or piggy-backed one on the other to thereby make more efficient use of the limited space available on the wearer's body.

The means of achieving these objectives and their attendant advantages will now be described in greater detail with reference to the accompanying drawings, wherein:

DETAILED DESCRIPTION OF ILLUSTRATED EMBODIMENTS

Figure 1:
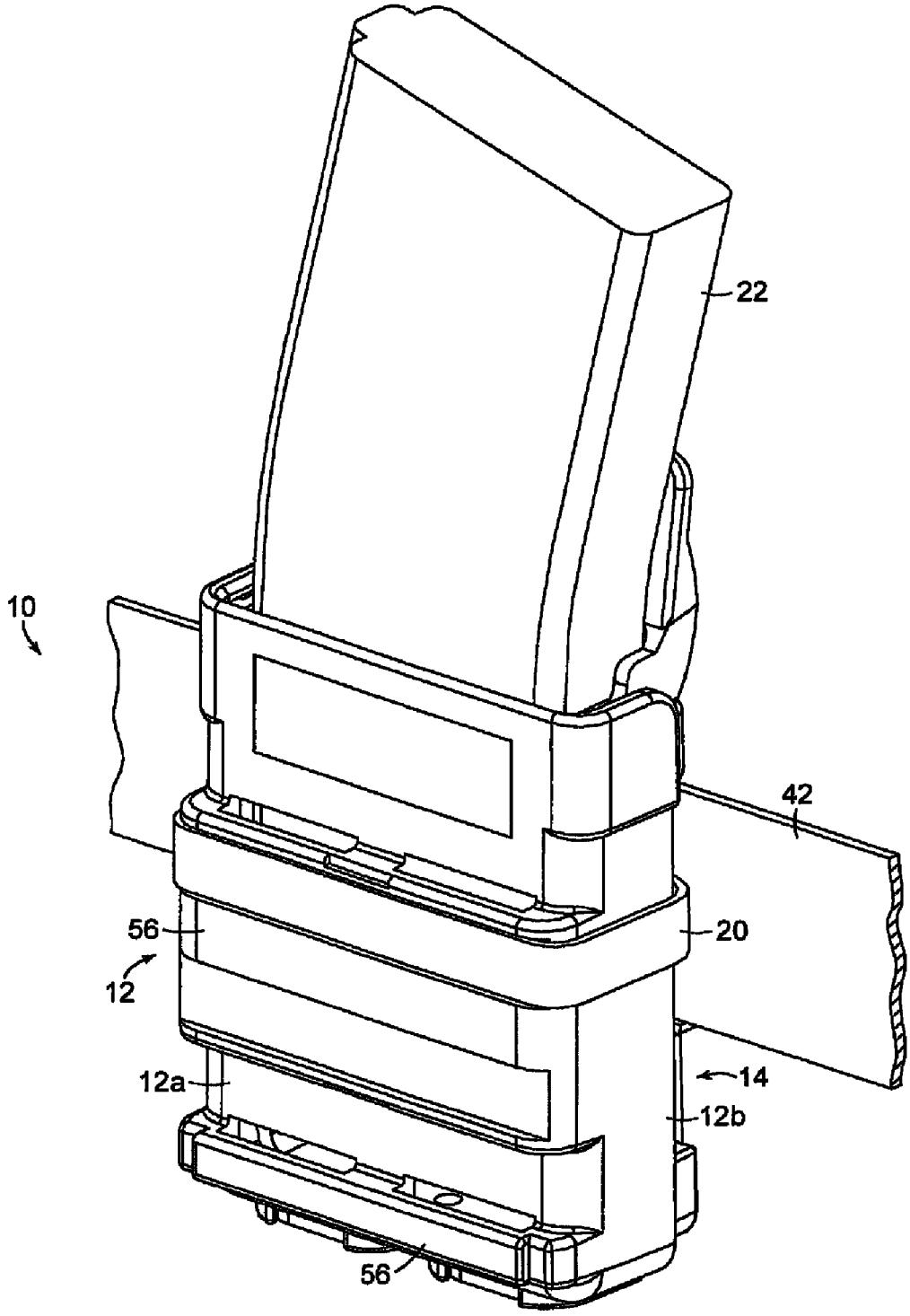
FIG. 1 is a front perspective view of a hinged pocket in accordance with the present invention, showing an ammunition magazine inserted in the pocket and the pocket installed on a belt.
Figure 2:
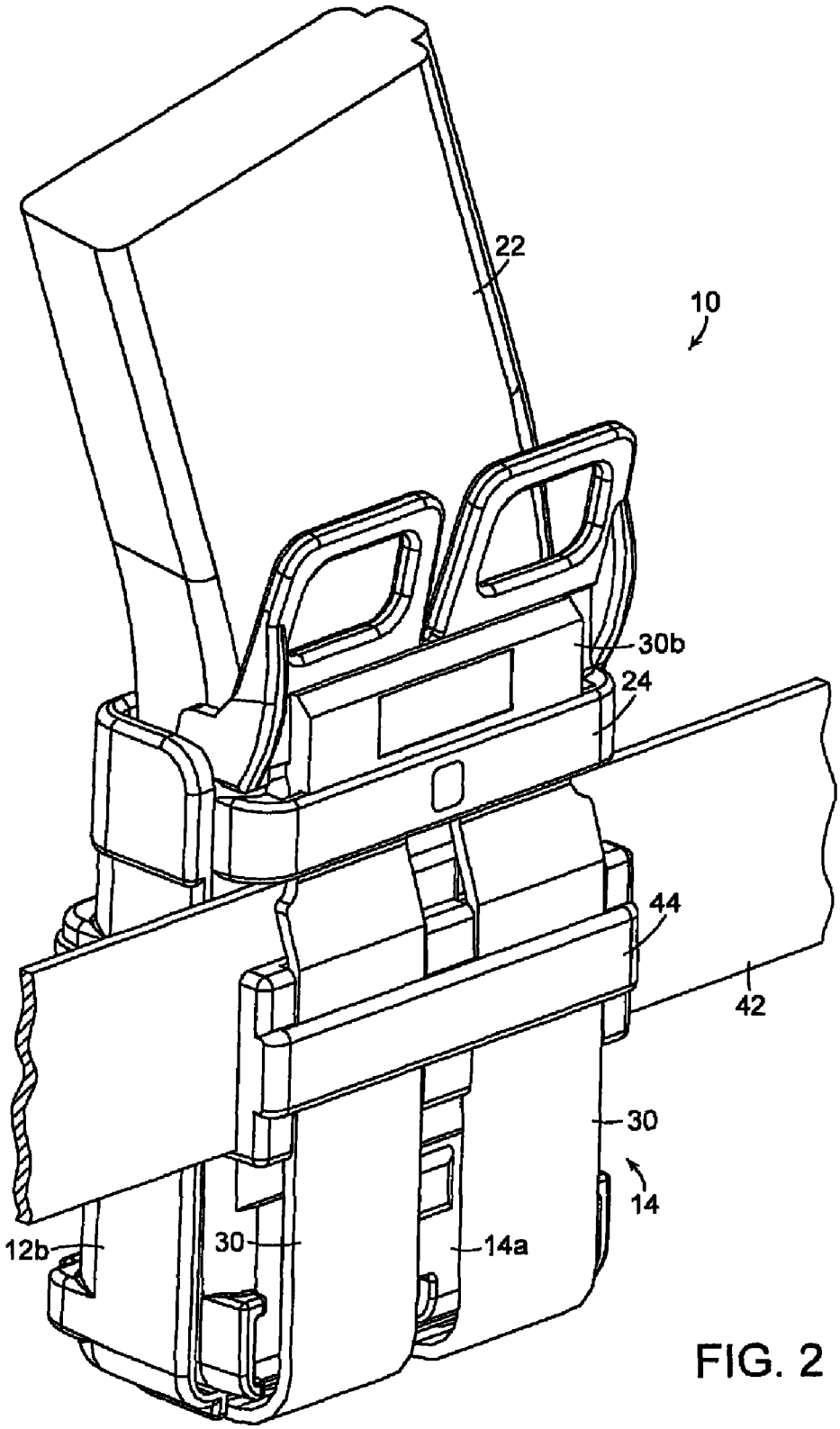
FIG. 2 is a rear perspective view of the hinged pocket as depicted in FIG. 1.

With reference initially to FIGS. 1-6, a hinged pocket in accordance with the present invention is generally depicted at 10. The hinged pocket includes a front component with a front wall 12*a*, side walls 12*b* and a bottom wall 12*c*, and a back component with a back wall 14*a*, side walls 14*b* and a bottom wall 14*c*.

The front and back components are assembled in a nested relationship with the side walls 14*a* of the back component 14 overlapped by the side walls 12*a* of the front component 12, and with the bottom wall 14*c* of the back component overlying the bottom wall 12*c* of the front component. When thus assembled, the bottom walls are interconnected by a first connecting means in the form of a rivet 16 or the like, with the nested front and back components 12, 14 coacting to define a chamber 18 having an open upper end and a bottom closed by the overlapped walls 12*c*, 14*c*.

Preferably, an elastic band 20 tightly surrounds the exterior of the pocket to resiliently urge the front component 12 into a closed position at which the sides of an ammunition magazine 22 or other like article are tightly confined between the front and back walls 12*a*, 14*a*.

Figure 5:
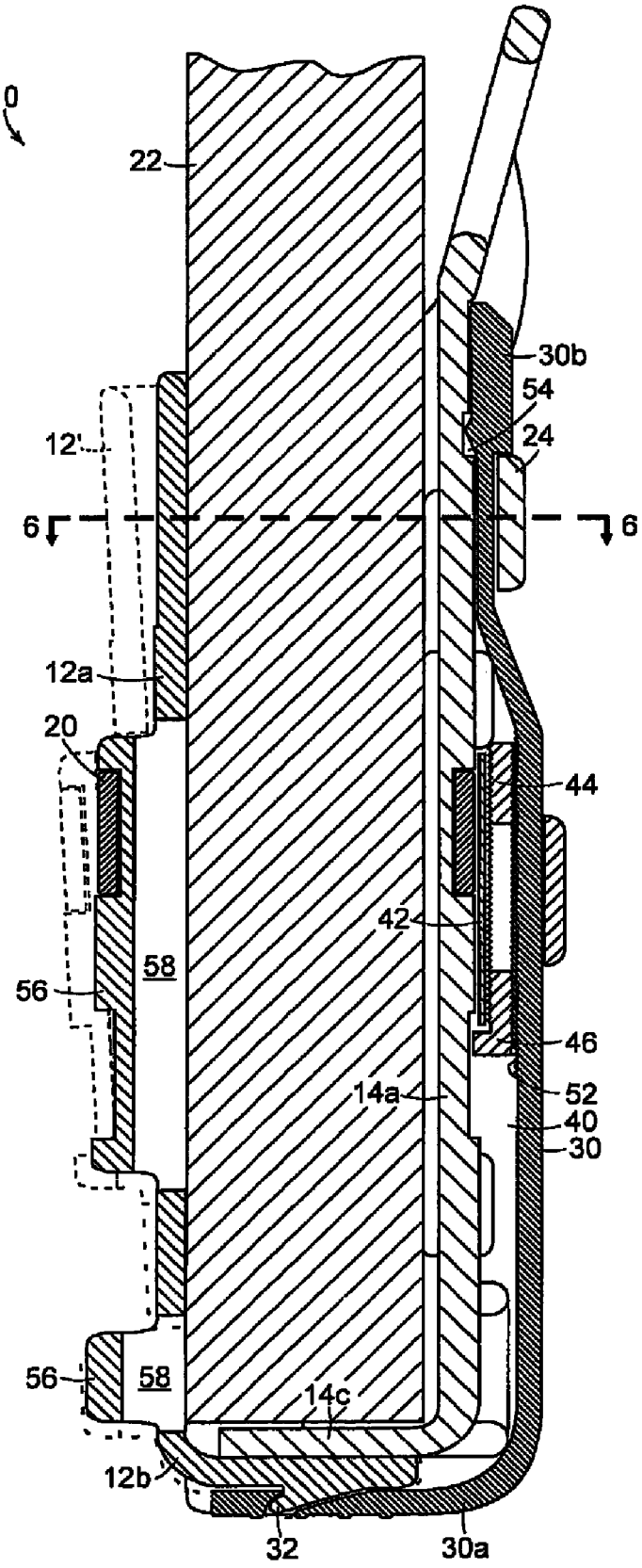
FIG. 5 is a vertical sectional view taken along line 5-5 of FIG. 4 with the ammunition magazine inserted in the pocket.
Figure 6:
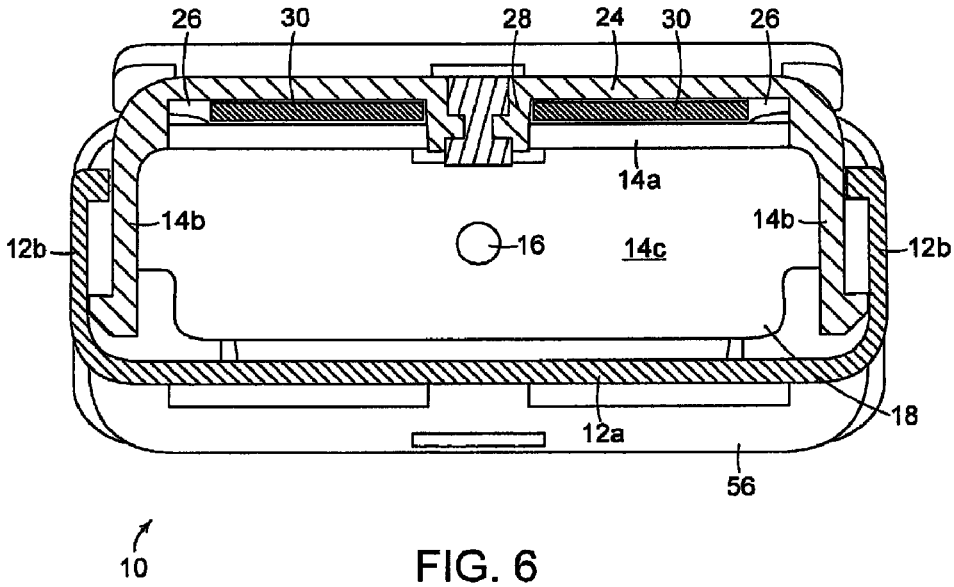
FIG. 6 is a horizontal sectional view taken on line 6-6 of FIG. 5.

The rivet 16 cooperates with the bottom walls 12*c*, 14*c*, the latter being somewhat flexible and resilient, to accommodate pivotal movement of the front component 12 relative to the back component 14, as depicted at 12' by the broken lines in FIG. 5, to thereby accommodate deflection of the front wall 12*a* away from the back wall 14*a*, thus freeing the magazine 22 for extraction from the chamber 18 through its open upper end.

A back mounting bar 24 extends across the exterior surface of back wall 14*a*. As can best be seen in FIG. 6, the mounting bar cooperates with the exterior of the back wall 14*a* to define parallel back channels 26 separated by a central boss 28.

A pair of flexible mounting straps 30 have lower ends 30*a*, and upper ends joined by a transverse web 30*b*.

The mounting straps 30 extend downwardly through the back channels 26 along the exterior of the back wall 14*a*. A second connecting means serves to detachably connect the lower ends 30*a* of the mounting straps 30 to the bottom wall 12*c*. Preferably, the second connecting means comprises hooks 32 molded into the outer surface of the bottom wall 12*c*, and apertures 34 in the lower strap ends 30*a* configured to engage with the hooks 32.

Figure 3:
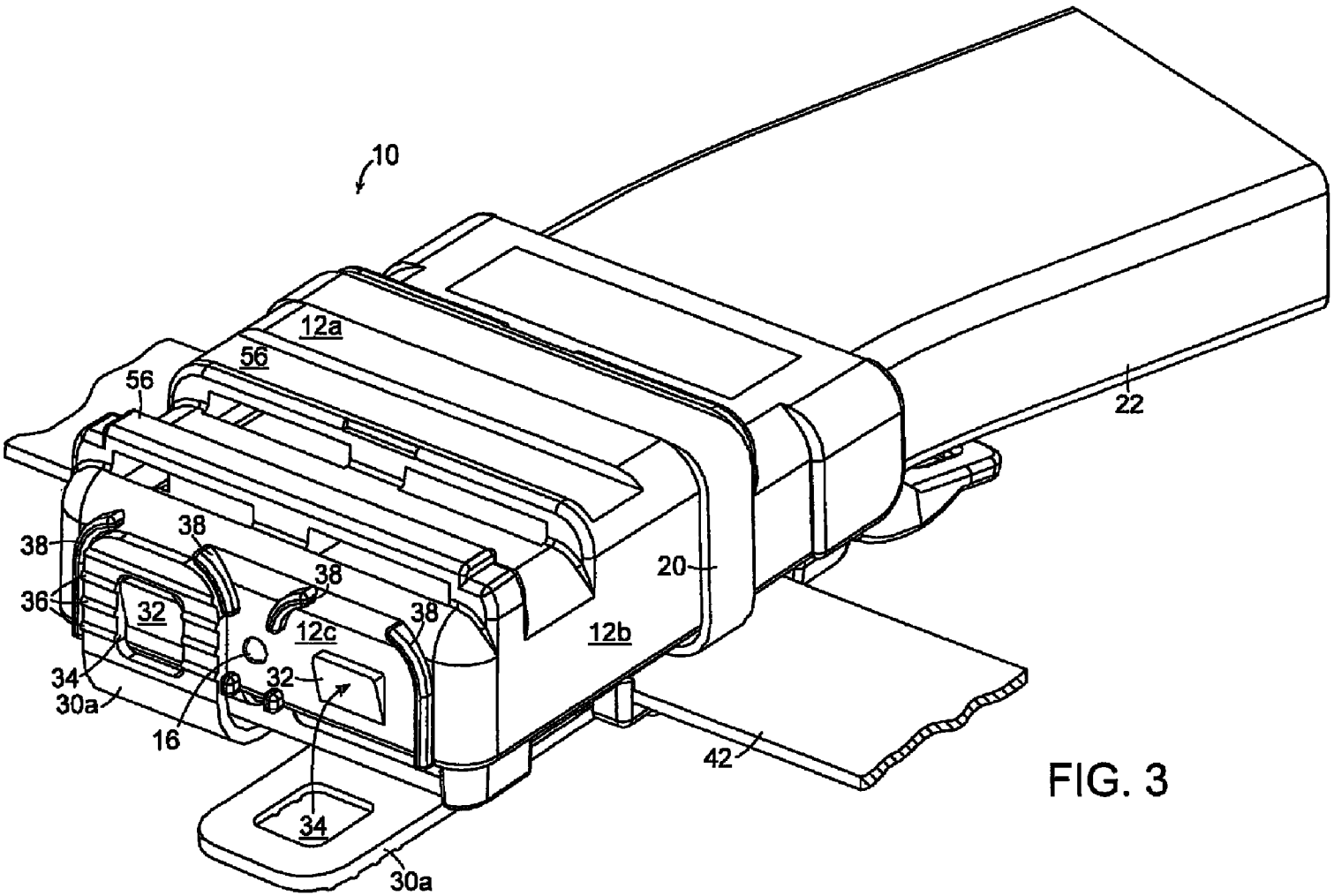
FIG. 3 is a bottom perspective view of the hinged pocket, showing the bottom end of one of the mounting straps disconnected.
Figure 4:
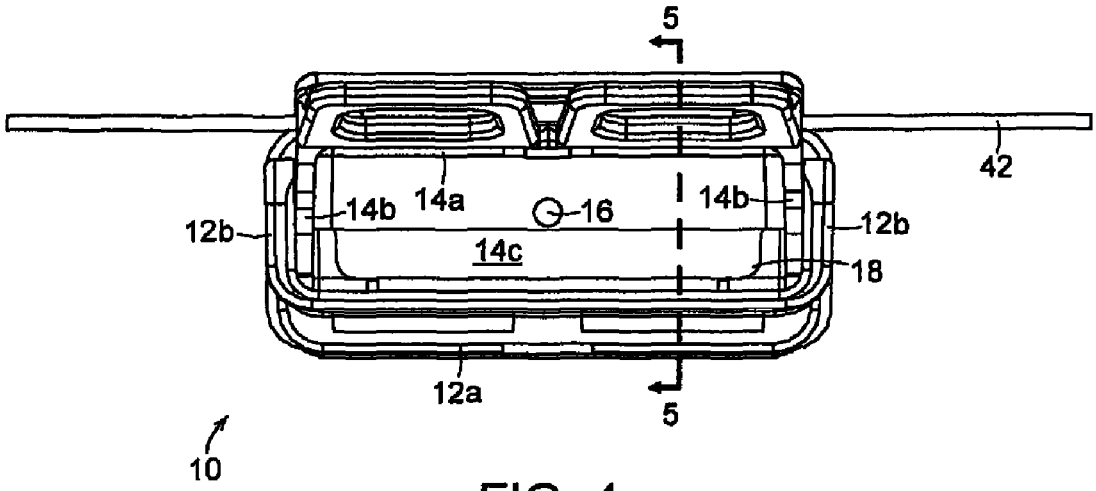
FIG. 4 is a top plan view of the hinged pocket in an empty condition.

As can best be seen in FIG. 3, the lower strap ends have raised ribs 36 which provide a gripping surface to facilitate stretching the strap ends 30*a* over the hooks 32. Raised guarding surfaces 38 on the exterior of the bottom wall 12*c* partially surround and serve to protect the strap ends from inadvertent release.

The mounting straps 30 are preferably elastic, and are stretched and in tension between the lower ends 30*a* when connected to the hooks 32, and the transverse web 30*b*, the latter abutting the back mounting bar 24 above the back channels 26. The tensioned segments of the mounting straps 30 thus cooperate with the exterior of the back wall 14*a* in defining a slot 40 through which a belt 42 or other like strap may be threaded.

Figure 9:
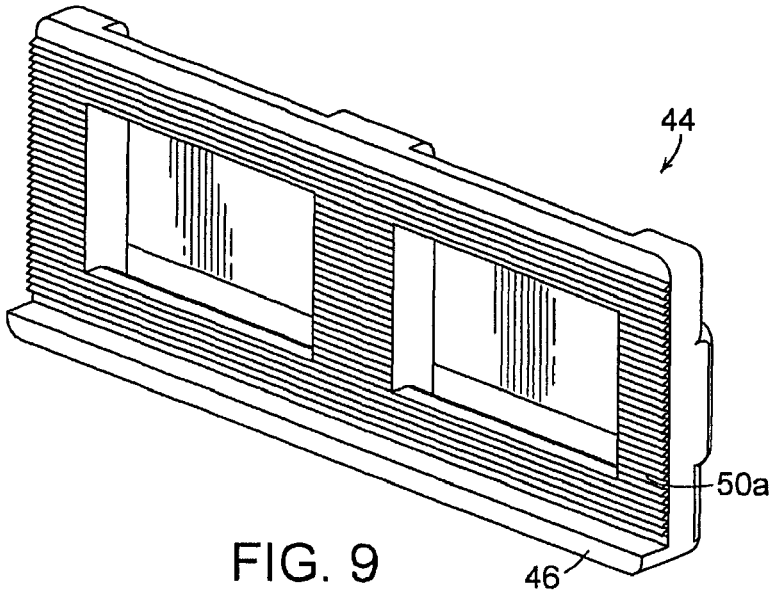
FIG. 9 is a front perspective view, on an enlarged scale, of the stabilizing plate.
Figure 10:
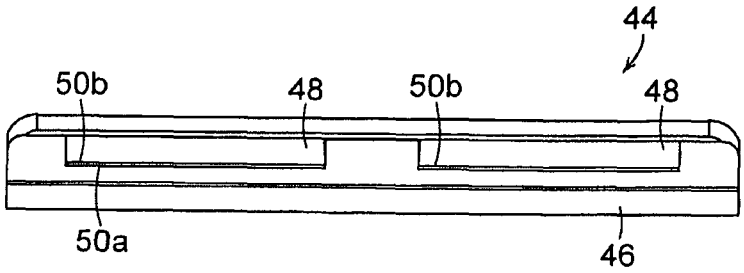
FIG. 10 is a top plan view of the stabilizing plate.
Figure 11:
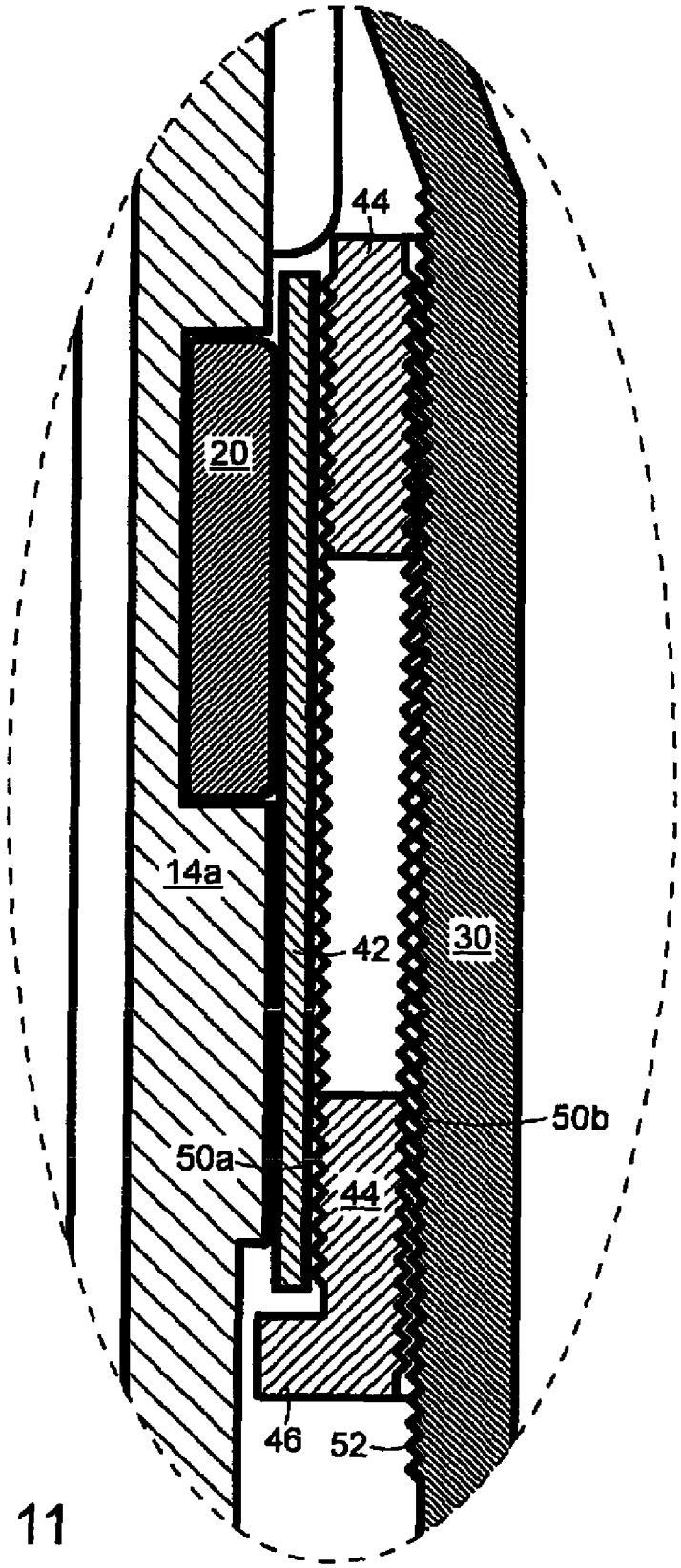
FIG. 11 is an enlarged partial sectional view of the area enclosed by the broken line in FIG. 8.

Optionally, a stabilizing plate 44 extends laterally between and is slidably received on the mounting straps 30 between the back mounting bar 24 and the points of connection of the lower strap ends 30*a* to the hooks 32. As can best be seen in FIGS. 9 and 10, the stabilizing plate includes a bottom front ledge 46, vertical back slots 48, and front and back surfaces that are roughened or serrated as at 50*a*, 50*b*. As shown in FIG. 11, when the stabilizing plate is in place, the mounting straps 30 extend downwardly through the back slots 48, the front ledge 46 underlies the lower edge of the belt 42, and the serrated or roughened surfaces 50*a*, 50*b* "bite" into the respective adjacent surfaces of the belt and mounting straps, thereby providing a friction/mechanical interaction which maintains the stabilizing plate in an optimum horizontal attitude, thus serving, with the front ledge 46, to hold the pocket in an optimum vertical orientation. Optionally, the interior surfaces of the mounting straps may be roughened or serrated as at 52 to further heighten this effect.

Preferably, the exterior of the back wall 14*a* is recessed as at 54 to receive and lock the transverse web 30*b* into its position abutting the back mounting bar 24.

At least one and preferably two front mounting bars 56 extend across and cooperate in spaced relationship with the exterior of the front wall 12*a* to define parallel front channels

Figure 7:
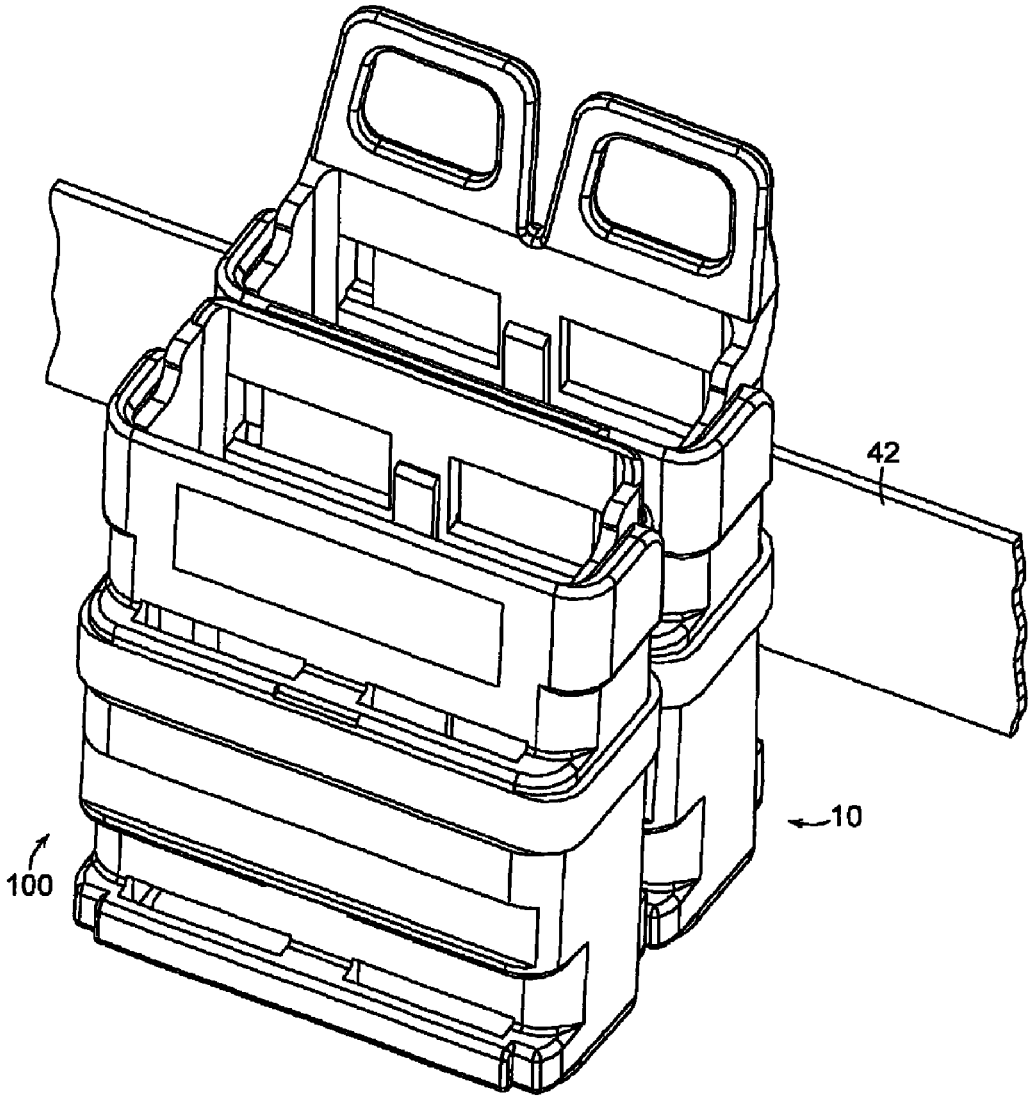
FIG. 7 is a front perspective view of two piggy-backed hinge pockets.
Figure 8:
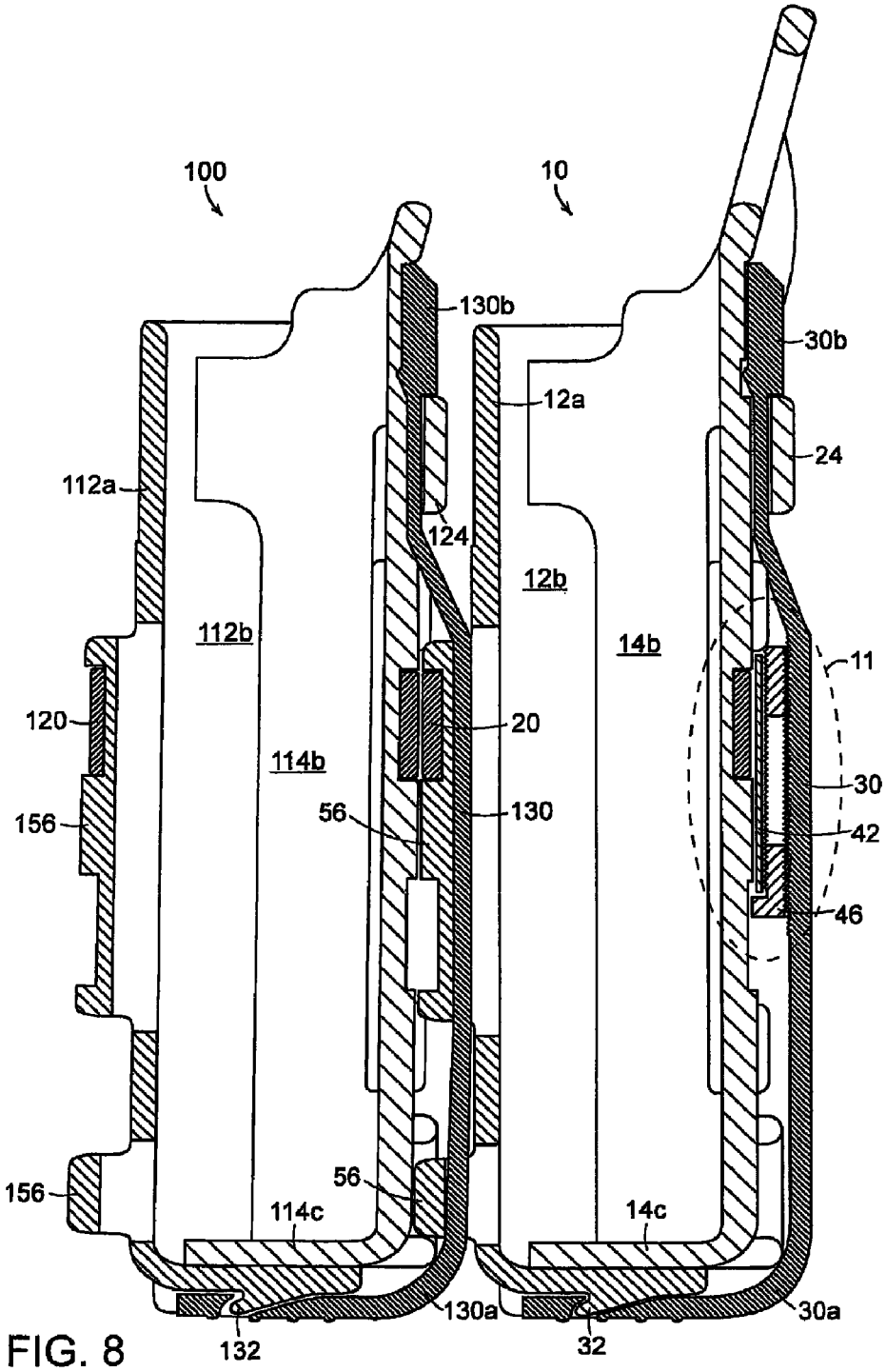
FIG. 8 is a vertical sectional view through the piggy-backed hinged pockets shown in FIG. 7.

58. As shown in FIGS. 7 and 8, this accommodates the piggy-back mounting of a second hinged pocket 100 onto the pocket 10. The parts of hinged pocket 100 that are identical or similar to components of pocket 10 have been identified with a "100" series of the same reference numerals. Thus, it will be seen that in a piggy backed assembly, the front channels 58 of pocket 10 are configured and arranged to accept the parallel mounting straps 130 of the second hinged pocket 100.

The invention claimed is:

1. A pocket for an article having oppositely facing sides, said pocket comprising:

a back component comprising a back wall with parallel first side walls and a first bottom wall projecting therefrom;

a front component comprising a front wall with parallel second side walls and a second bottom wall projecting rearwardly therefrom, said back and front components cooperating in a nested relationship to define a chamber having an open upper end sized to receive said article, with said front and back walls in a confronting relationship, with said first side walls confined between said second side walls, and with said first bottom wall overlapping and supported on said second bottom wall;

first connecting means projecting through and cooperating with said bottom walls to accommodate movement of said front component relative to said back component between a closed position at which an article received in said chamber has an externally accessible portion thereof projecting through said open upper end and in which resistance to removal of said article from said chamber is provided by a tight confinement of the sides of said article between and in contact with said front and back walls, and a release position at which said front wall is deflected away from said back wall to relieve said resistance and to accommodate removal of said article from said chamber via said open upper end;

a back mounting bar extending across and cooperating in spaced relationship with the exterior of said back wall to define parallel back channels;

a pair of flexible mounting straps having lower ends and upper ends joined by a transverse web, said mounting straps extending downwardly through said back channels along the exterior of said back wall; and second connecting means for detachably connecting the lower ends of said mounting straps to one of said bottom walls, said mounting straps cooperating with the exterior of said back wall to define a belt receiving slot.

2. The pocket of claim 1 wherein said mounting straps are elastic and in tension between said back mounting bar and said second connecting means.

3. The pocket of claim 1 or 2 wherein said transverse web abuts said back mounting bar above said back channels.

4. The pocket of claim 3 further comprising a recess in the exterior surface of said back wall adjacent to said back mounting bar, said recess being configured and dimensioned to receive said transverse web.

5. The pocket of claim 1 wherein said second connecting means comprises hook members on the said one of said bottom walls, and apertures in the lower ends of said straps, said apertures being configured and dimensioned to interlock with said hook members.

6. The pocket of claim 1 further comprising a stabilizing plate extending laterally between and slidably mounted on said mounting straps at a location between said back mounting bar and said second connecting means.

7. The pocket of claim 1 further comprising at least one front mounting bar extending across and cooperating in spaced relationship with the exterior of said front wall to define parallel front channels, said front channels being configured and dimensioned to receive the mounting straps of another of said pockets.

8. The pocket of claim 7 wherein two vertically spaced front mounting bars are provided on the exterior of said front wall.

* * * * *